US012673807B2

(12) United States Patent
Mansi

(10) Patent No.: US 12,673,807 B2
(45) Date of Patent: Jul. 7, 2026

(54) LID ASSEMBLY FOR A CONTAINER

(71) Applicant: Nael Abed Mansi, Amman (JO)

(72) Inventor: Nael Abed Mansi, Amman (JO)

( * ) Notice: Subject to any disclaimer, the term of this patent is extended or adjusted under 35 U.S.C. 154(b) by 293 days.

(21) Appl. No.: 17/538,954

(22) Filed: Nov. 30, 2021

(65) Prior Publication Data

US 2022/0177203 A1 Jun. 9, 2022

Related U.S. Application Data

(60) Provisional application No. 63/122,737, filed on Dec. 8, 2020.

(51) Int. Cl.

| | |
|---|---|
| ***B65D 51/18*** | (2006.01) |
| ***B65D 43/02*** | (2006.01) |
| ***F28D 21/00*** | (2006.01) |

(52) U.S. Cl.

CPC ..... *B65D 51/185* (2013.01); *B65D 43/0202* (2013.01); *F28D 21/0015* (2013.01); *B65D 2543/00046* (2013.01); *B65D 2543/00092* (2013.01); *B65D 2543/00231* (2013.01)

(58) Field of Classification Search

CPC ..... B65D 2543/00046; B65D 43/0202
USPC ..... 220/374, 719
See application file for complete search history.

(56) References Cited

U.S. PATENT DOCUMENTS 6,276,559 B1 * 8/2001 DeMars ..... A47G 19/2266 215/229
2005/0205587 A1 * 9/2005 Sampson ..... A47G 19/2272 220/731

* cited by examiner

*Primary Examiner* — Jeffrey R Allen
(74) *Attorney, Agent, or Firm* — Steven R. Fairchild

(57) ABSTRACT

The present invention relates to a lid assembly (100) for outfitting a container (102), capable of immediate cooling of liquids discharged from the container (102). The lid assembly (100) comprises a lid (202), a fluid control flow chamber (204) having a discharge opening (206) on an upper surface of the lid (202), and an air tunnel (208) passing through a connection slot (212) to the fluid control flow chamber (204). The air tunnel (208) has a first end (208-1) disposed in the fluid control flow chamber (204) and a second end (208-2) passing through the lid (202) such that the second end (208-2) is disposed outside the lid (202). The second end (208-2) of the air tunnel (208) directs external air to the first end (208-1) of the air tunnel (208). The fluid control flow chamber (204) mixes the external air directed to the first end (208-1) of the air tunnel (208) with a liquid discharged from the container (102) when suction pressure is generated in the discharge opening (206) of the fluid control flow chamber (204).

7 Claims, 9 Drawing Sheets

LID ASSEMBLY FOR A CONTAINER

CROSS-REFERENCE TO RELATED APPLICATIONS

This application claims priority to U.S. Patent Application No. 63/122,737 filed on Dec. 8, 2020, the entire contents of which are hereby incorporated by reference.

TECHNICAL FIELD

The present invention relates to a lid assembly for outfitting a container. More particularly, the present invention relates to a lid assembly for outfitting a container capable of immediately cooling hot beverages discharged from the container.

BACKGROUND

Background description includes information that may be useful in understanding the present invention. However, it is not an admission that any of the information provided herein is prior art or relevant to the presently claimed invention or that any explicitly or implicitly referenced publication is prior art.

A lid assembly that covers an upper side of a container is generally applied to a beverage cup containing hot liquid such as coffee or tea sold in coffee shops or the like. The lid assembly is usually made of a synthetic resin material, which prevents the beverage from overflowing and pouring, allowing the container to move safely, and allowing a user to drink the beverage through a discharge opening thereof.

People enjoy drinking hot beverages directly from a container without waiting for the beverage to reach the appropriate drinking temperature. However, hot beverages, such as coffee and tea, are often served at temperatures between 150 Fahrenheit (66 Celsius) and 180 Fahrenheit (82 Celsius). Studies have shown that even a brief sip of liquids at such temperatures can scald the tongue.

Hot beverages such as tea, hot chocolate, and coffee are typically served at temperatures between 160 Fahrenheit (71.1 Celsius) and 185 Fahrenheit (85 Celsius). Brief exposures to liquids in such temperature range cause significant scald burns to the tongue. Studies show that the coffee's preferred drinking temperature is between a temperature range of 155 Fahrenheit (68.3 Celsius) to 125 Fahrenheit (51.7° C.). The studies also recommend reducing the serving temperature of beverages to achieve the combined result of reducing scald burn hazards and improving customer satisfaction.

The existing available hot beverage cup lids in the market do not address the above deficiencies. Such cup lids cause serious tongue, lips, and mouth severe burns if the user drinks from the lid while the drink is still scalding hot. Moreover, these lids provide little protection from spills or sloshing while holding or moving.

Therefore, there is a need to develop a lid assembly for outfitting a container to address the aforementioned deficiencies.

OBJECTS OF THE PRESENT INVENTION

An object of the present invention is to provide a lid assembly for outfitting a container.

Another object of the present invention is to provide a lid assembly for outfitting a container capable of cooling hot beverages discharged from the container immediately.

Another object of the present invention is to provide a lid assembly for a container that prevents scald burn hazards to users.

Still, another object of the present invention is to provide a lid assembly capable of being retrofitted to containers of various shapes and sizes.

Nevertheless, another object of the present invention is to provide a lid assembly for a container that decreases spilling or leakage of the beverage from a drinking hole of the lid assembly.

SUMMARY

An aspect of the present invention relates to a lid assembly for a container for cooling a liquid beverage discharged from the container while minimizing the chance of scald burns hazards to users drinking the hot liquid beverage. The lid assembly includes a lid, a fluid control flow chamber having a discharge opening on the surface of the lid, and at least one air tunnel passing through a connection slot of the fluid control flow chamber. At least one air tunnel has a first end in the fluid control flow chamber and a second end passing through the lid such that the second end is disposed outside the lid.

The second end of the air tunnel directs external air to the first end of the air tunnel. The fluid control flow chamber mixes the external air directed to the first end of the air tunnel with a liquid discharged from the container. This happens when suction pressure, negative pressure, is generated in the discharge opening of the fluid control flow chamber.

According to an embodiment of the present invention, the lid may include a ventilation hole on the upper surface thereof to enable ventilation of the liquid accommodated in the container.

According to an embodiment of the present invention, the fluid control flow chamber may include a plurality of holes to enable the liquid discharged from the container to flow towards the discharge opening.

According to an embodiment of the present invention, the first end of the air tunnel is disposed in the fluid control flow chamber to direct the external air into the fluid control flow chamber along a specific path.

According to an embodiment of the present invention, the second end of the air tunnel is disposed outside the lid to suck the external ambient air when the suction pressure is generated in the discharge opening of the fluid control flow chamber.

According to an embodiment of the present invention, the fluid control flow chamber mixes the external air with the liquid discharged from the container to reduce the liquid's temperature discharged from the container.

According to an embodiment of the present invention, the fluid control flow chamber may be integrated with the lid.

According to an embodiment of the present invention, the connection slot ensures an air-tight connection between the air tunnel and the fluid control flow chamber.

According to an embodiment of the present invention, the air tunnel is positioned below the upper surface of the lid. According to another embodiment of the present invention, the air tunnel is positioned above the upper surface of the lid.

According to an embodiment of the present invention, the fluid control flow chamber may contain one or more sub-chambers to increase the heat exchange area. The first sub-chamber may receive the air from the first end of the air tunnel. The first end of the air tunnel placed in one of the sub-chambers may be in the form of a nozzle to increase the velocity of the external air directed into the first sub-chamber and focus the directed air more effectively on the liquid. The external air directed to the first end of the air tunnel is mixed with the liquid discharged from the container in one of the sub-chambers.

According to an embodiment of the present invention, the first end of the air tunnel disposed in the chamber, or any sub-chambers, maybe in the form of convex-shaped opening to increase the velocity and redistribute the external air directed into the chamber and to focus the directed air more effectively on the liquid.

According to an embodiment of the present invention, the chamber may include a fluid entrance slot to receive the liquid discharged from the container. The fluid entrance slot may receive the liquid from a liquid delivery tube that may have a curved part adapted to pass the liquid into the chamber when the suction pressure is generated in the discharge opening of the fluid control flow chamber.

According to an embodiment of the present invention, the liquid delivery tube having the curved part may be positioned such that the curved part is vertically arranged with respect to the chamber.

According to an embodiment of the present invention, the sub-chambers are separated by a wall that includes at least one hole to allow the mixture of the liquid and the external air to flow towards the next chamber and increase the mixing areas and the mixing duration.

According to an embodiment of the present invention, the first end of the air tunnel disposed in the chamber may be in the form of a nozzle to increase the velocity and pressure of the external air directed into the fluid control flow chamber.

According to an embodiment of the present invention, the liquid delivery tube having the curved part may be positioned such that the curved part is vertically arranged with respect to the fluid control flow chamber.

According to an embodiment of the present invention, the chamber may be in the shape of a spiral tube that may include a plurality of curved parts to increase mixing area size while the mixed liquid and air pass through the spiral tube towards the discharge opening the fluid control flow chamber.

According to an embodiment of the present invention, the spiral tube may include one or more inlets, the first inlet is connected to the fluid entrance slot, and the other inlets may be connected to the discharge opening of the fluid control flow chamber.

According to an embodiment of the present invention, the spiral tube having the plurality of curved parts may also include a plurality of spaced bubble-forming apertures to enlarge heat exchange area and to enhance liquid and air mixing. According to another embodiment of the present invention, the spiral tube may include a plurality of stepped portions having reduced diameter to increase pressure when the liquid passes through the spiral tube towards the discharge opening of the chamber, and as a result, increasing the mixing efficiency.

According to an embodiment of the present invention, the fluid control flow chamber may be in the form of a tube or a pipe having a plurality of holes.

According to another aspect of the present invention, the lid assembly includes a lid having a discharge opening, at least one air tunnel having a first end connected to the discharge opening, and a second end passing through the lid such that the second end is disposed outside the lid, and at least one liquid delivery tube having a first end configured to receive a liquid discharged from the container and a second end disposed in proximity of the second end of the at least one air tunnel or at least one hole that works as fluid control flow point.

According to an embodiment of the present invention, the second end of the air tunnel directs external air to the first end of the air tunnel. The external air is directed to the first end of the air tunnel and is mixed with the liquid passing through the second end of the liquid delivery tube/the entrance of fluid control flow chamber, when suction pressure is generated in the discharge opening of the lid.

According to an embodiment of the present invention, the air tunnel may be a tube having a curved profile. According to another embodiment of the present invention, the air tunnel may be a tube having a flat profile, that may work as the mixing chamber.

BRIEF DESCRIPTION OF ACCOMPANYING DRAWINGS

The accompanying drawings are included to provide a further understanding of the present disclosure and are incorporated in and constitute a part of this specification. The drawings illustrate exemplary embodiments of the present disclosure and, together with the description, serve to explain the principles of the present disclosure.

In the figures, similar components and-or features may have the same reference label. Further, various components of the same type may be distinguished by following the reference label with a second label that distinguishes similar components. If only the first reference label is used in the specification, the description is applicable to any one of the similar components having the same first reference label irrespective of the second reference label.

DETAILED DESCRIPTION OF THE INVENTION

As used in the description herein and throughout the claims that follow, the meaning of "a," "an," and "the"

includes plural reference unless the context clearly dictates otherwise. Also, as used in the description herein, the meaning of "in" includes "in" and "on" unless the context clearly dictates otherwise.

If the specification states a component or feature "may", "can", "could", or "might" be included or have a characteristic, that particular component or feature is not required to be included or have the characteristic.

Exemplary embodiments will now be described more fully hereinafter with reference to the accompanying drawings, in which exemplary embodiments are shown. This disclosure may, however, be embodied in many different forms and should not be construed as limited to the embodiments set forth herein. These embodiments are provided so that this disclosure will be thorough and complete and will fully convey the scope of the disclosure to those of ordinary skill in the art. Moreover, all statements herein reciting embodiments of the disclosure, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Various terms as used herein are shown below. To the extent a term used in a claim is not defined below, it should be given the broadest definition persons in the pertinent art have given that term as reflected in printed publications and issued patents at the time of filing.

In some embodiments, the numerical parameters outlined in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain specific errors necessarily resulting from the standard deviation found in their respective testing measurements.

The present invention relates to a lid assembly for a container for cooling hot liquid beverage discharged from the container immediately before entering the user's mouth while significantly minimizing the possibility of scald burn hazard to the user drinking the hot beverage.

Figure 1:
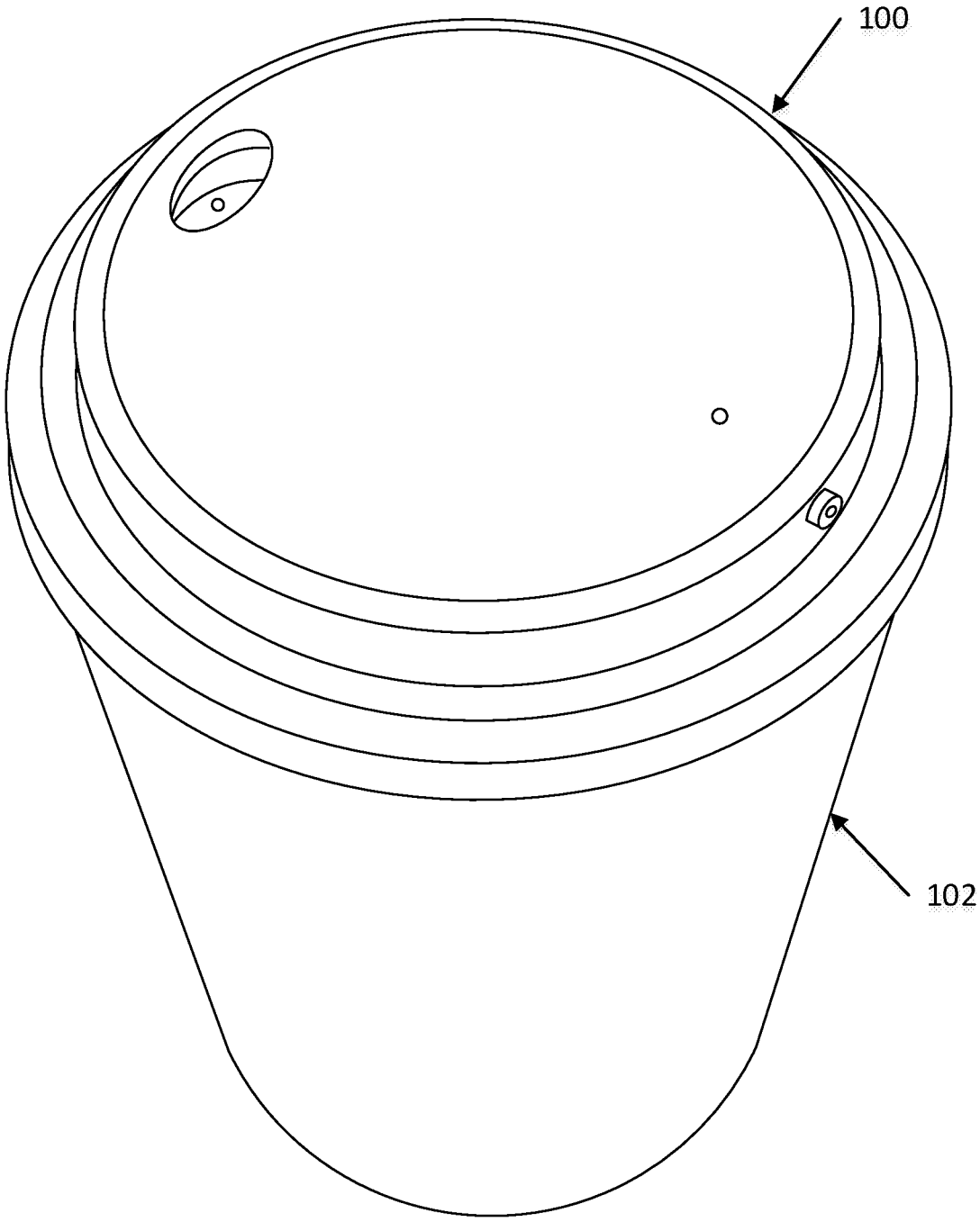
FIG. 1 illustrates an exemplary representation of a lid assembly for outfitting a container in the form of a beverage cup, in accordance with embodiments of the present invention.

FIG. 1 illustrates an exemplary representation of a lid assembly (100) for outfitting a container (102) in the form of a beverage cup, in accordance with embodiments of the present invention. The lid assembly (100) may be mounted over an opening of the container (102). The lid assembly (100) includes a lid (as clearly shown in FIG. 2A) which may have any shape and size depending upon the design and requirement of the container (102). The container (102) may accommodate a liquid beverage, such as tea, coffee, hot chocolate, etc.

According to an embodiment of the present invention, the lid assembly (100), when outfitted with the container (102), reduces the temperature of the liquid beverage discharged from the container (102) by mixing external air with the liquid beverage, accompanied by the pressure difference caused by the suction, and with specific holes (214) in the fluid control flow chamber (204) that causes the liquid to change into a plurality of droplets through liquid atomization process. The liquid droplets expand the overall liquid surface size of the sip, enlarging the overall liquid surface size exposed to the air, thereby causing an immediate decrease to the sipped liquid temperature before entering the drinker's mouth.

According to an embodiment of the present invention, the container (102) may be any type of cup of any size and shape, a plastic cup, a wooden cup, a glass cup, or vessels.

FIGS. 2A through 2D illustrate exemplary perspective view representations of the lid assembly in accordance with embodiments of the present invention. The lid assembly (100) includes a lid (202) having an upper surface and a fluid control flow chamber (204) having a discharge opening (206) on the upper surface of the lid (202).

According to an embodiment of the present invention, the fluid control flow chamber (204) may be located at the bottom surface of the lid (202) and underneath the discharge opening (206). According to another embodiment of the present invention, the fluid control flow chamber (204) may be located on the upper surface of the lid (202). The fluid control flow chamber (204) controls and suppresses the amount of liquid beverage passing through the discharge opening (206) and then to the drinker's mouth. The fluid control flow chamber (204) may also function as a mixing and heating exchange area between the liquid and the air.

The lid assembly (100) also includes an air tunnel (208) passing through a connection slot (212) of the fluid control flow chamber (204). The air tunnel (208) has a first end (208-1) disposed in the fluid control flow chamber (204) and a second end (208-2) passing through the lid (202) such that the second end (108-2) is disposed outside the lid (202). According to an embodiment of the present invention, the air tunnel (208) may be tightened and its diameter may be decreased in size towards the first end (208-1), to suppress the generation of noise when the external air flows from the second end (208-2) to the first end (208-1) of the air tunnel (208).

The second end (208-2) of the air tunnel (208) directs external air to the first end (208-1) of the air tunnel. The fluid control flow chamber mixes (204) the external air directed to the first end (208-1) of the air tunnel (208) with a liquid discharged from the container (102), when suction pressure is generated in the discharge opening (206) of the fluid control flow chamber (204).

According to an embodiment of the present invention, the fluid control flow chamber (204) mixes the external air with the liquid discharged from the container (102) to reduce the temperature of the liquid discharged from the container (102).

According to an embodiment of the present invention, the lid (202) may be made up of materials, such as but not limited to, Polyethylene terephthalate (PET), High-density polyethylene (HDPE), Polypropylene (PP), Low-density polyethylene (LDPE), any kind of plastic, metal, rubber, glass, and wood.

According to an embodiment of the present invention, the upper surface of the lid (202) may have a ventilation hole (210) to enable ventilation of the liquid accommodated in the container (102).

According to an embodiment of the present invention, the fluid control flow chamber (204) may be integrated with the lid (202). The fluid control flow chamber (204) may be a built-in part of the lid (202) or maybe formed at a separate chamber.

Figure 3:
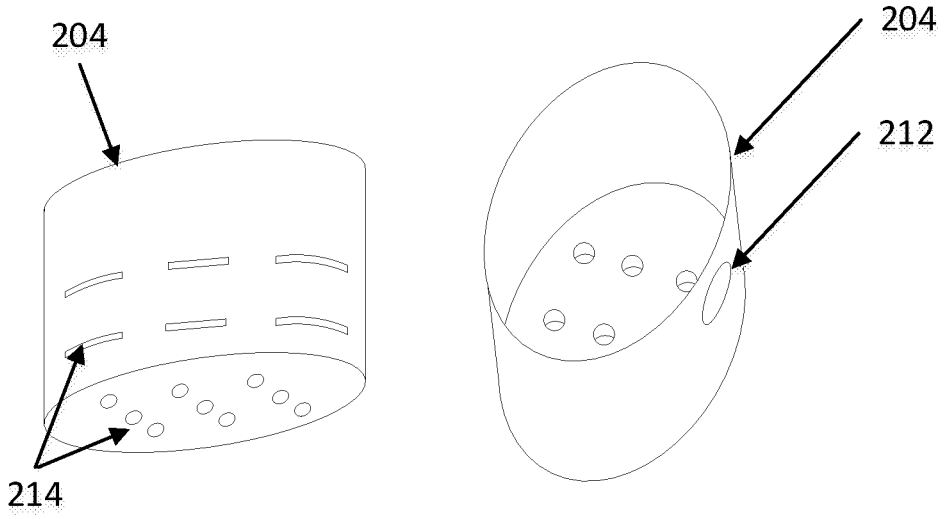
FIG. 3 illustrates an exemplary representation of a fluid control flow chamber of the lid assembly in accordance with embodiments of the present invention.

Referring now to FIG. 3, where the fluid control flow chamber (204) of the lid assembly (100) is shown. The fluid control flow chamber (204) may include a plurality of holes (214) to enable the liquid discharged from the container (102) to flow towards the discharge opening (206). The holes (214) may be formed on any surface of the fluid control flow chamber (204). The holes (214) may have shapes, such as, but not limited to, circles, lines, and triangles. The holes (214) may be formed as nozzles that atomize the liquid flowing to the fluid control flow chamber (204), changing the liquid into a plurality of droplets or atomized form.

According to an embodiment of the present invention, the fluid control flow chamber (204) may have any size and shape, such as but not limited to a cylinder shape, a rectangular shape, a regular or non-regular geometrical shape, a non-geometric shape. The fluid control flow chamber (204) chamber may also be assembled as a tube shape that may be formed as a spiral revolving like a cylinder. The fluid control flow chamber (204) may be a straight tube. According to another embodiment of the present invention, the fluid control flow chamber (204) may be in the form of a cylinder or a geometrical or non-geometrical shape.

Figure 4A:
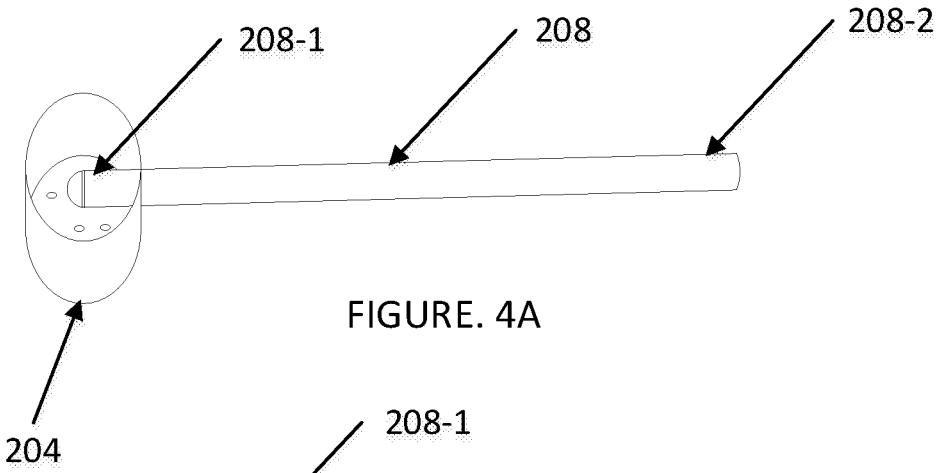
FIGS. 4A and 4B illustrate exemplary perspective view representations of the configuration of a fluid control flow chamber and an air tunnel of the lid assembly in accordance with embodiments of the present invention.
Figure 4B:
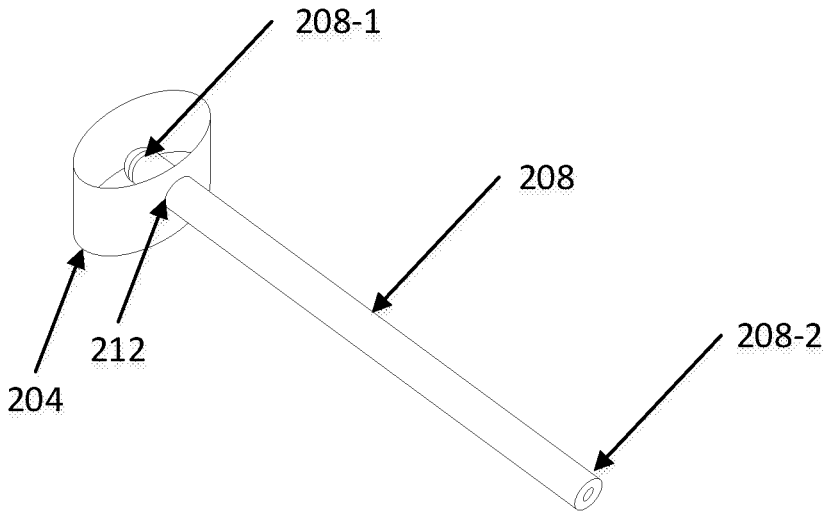

FIGS. 4A and 4B illustrate exemplary perspective views and representations of the configuration of the fluid control flow chamber (204) and the air tunnel (208) of the lid assembly (100) in accordance with embodiments of the present invention. The first end (208-1) of the air tunnel (208) is disposed in the fluid control flow chamber (204) to direct the external air into the fluid control flow chamber (204) along a specific path.

According to an embodiment of the present invention, the first end (208-1) of the air tunnel (208) residing in the fluid control flow chamber (204) is a relatively small portion of the air tunnel (208) that may be put at any angle to direct the air to a specific path. Furthermore, the first end (208-1) of the air tunnel (208) can also be assembled as a nozzle-like to control the flow and distribution of air inside the fluid control flow chamber (204). The first end (208-1) of the air tunnel (208) may be provided in the fluid control flow chamber (204) at any angle.

According to an embodiment of the present invention, the air tunnel (208) may be positioned below the upper surface of the lid (202). According to another embodiment of the present invention, the air tunnel (208) may be positioned above the upper surface of the lid (202).

According to an embodiment of the present invention, the air tunnel (208) acts as an air passage and may be formed in a hollow shape like an air tube. The air tunnel (208) may have a shape, such as, but not limited to, a tubular shape, a rectangular shape, a triangular shape, and other shapes.

According to an embodiment of the present invention, the second end (208-2) of the air tunnel (208) is disposed outside the lid (202) to suck the external air when the negative pressure is generated through the discharge opening (206) of the fluid control flow chamber (204).

In an implementation, when a drinker uses the discharge opening (206) of the fluid control flow chamber (204) to drink a beverage accommodated in the container (102), the air suction generated by the drinker creates a negative pressure inside the fluid control flow chamber (204), causing a certain amount of the beverage in the container (102) to flow inside the fluid control flow chamber (204) through the holes (214). Simultaneously, the suction causes the external air to come inside the fluid control flow chamber (204) through the air tunnel (208), causing the beverage and the external air to merge and mix inside the fluid control flow chamber (204). This merge and mixing between the external air and the beverage, accompanied by pressure difference, causes the beverage inside the fluid control flow chamber (204) to change into a plurality of droplets or spray form. The liquid droplets expands the surface size of liquid exposed to the external air, causing an immediate decrease in the beverage's temperature before entering the drinker's mouth.

Figure 5:
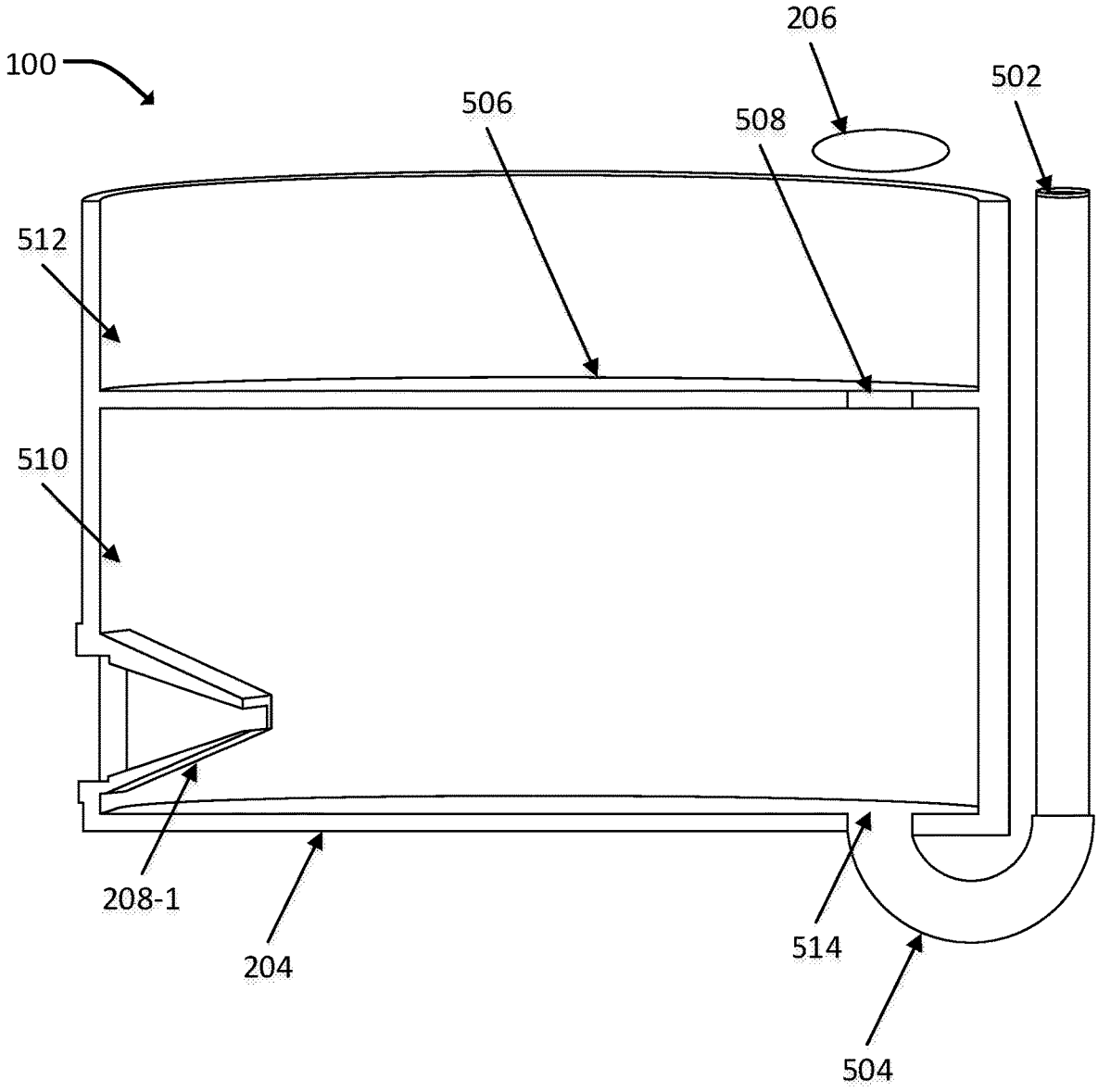
FIGS. 5 through 8 illustrate various exemplary representations of the fluid control flow chamber of the lid assembly in accordance with embodiments of the present invention.

FIGS. 5 through 8 illustrate exemplary representations of the fluid control flow chamber (204) of the lid assembly in accordance with embodiments of the present invention. As shown in FIG. 5, the fluid control flow chamber (204) may include one or more sub-chambers, for instance, a first sub-chamber (510) and a second sub-chamber (512). The first sub-chamber (510) may receive the first end (208-1) of the air tunnel (208). The first end (208-1) of the air tunnel (208) disposed in the first sub-chamber (510), and it may be in the form of a nozzle to increase the velocity of the external air directed into the first sub-chamber (510). Alternatively, the first end (208-1) of the air tunnel (208) disposed in the first sub-chamber (510) may be in the form of a convex-shaped opening to distribute and increase the velocity of the external air directed into the first sub-chamber (510).

According to an embodiment of the present invention, the first sub-chamber (510) may include a fluid entrance slot (514) to receive the liquid discharged from the container (102). The fluid entrance slot (514) may receive the liquid from a liquid delivery tube (502) having a curved part (504) adapted to pass the liquid into the first sub-chamber (510) when the suction pressure is generated in the discharge opening (206) of the fluid control flow chamber (204).

According to an embodiment of the present invention, the liquid delivery tube (502) having the curved part (504) may be positioned such that the curved part (504) is vertically arranged with respect to the first sub-chamber (510).

According to an embodiment of the present invention, the external air directed to the first end (208-1) of the air tunnel (208) is mixed with the liquid discharged from the container (102) in the first sub-chamber (510).

According to an embodiment of the present invention, the first sub-chamber (510) and the second sub-chamber (512) are separated by a separator wall (506) which includes at least one or more hole (508) to allow the mixture of the liquid and the external air to flow towards the second sub-chamber (512).

Figure 6:
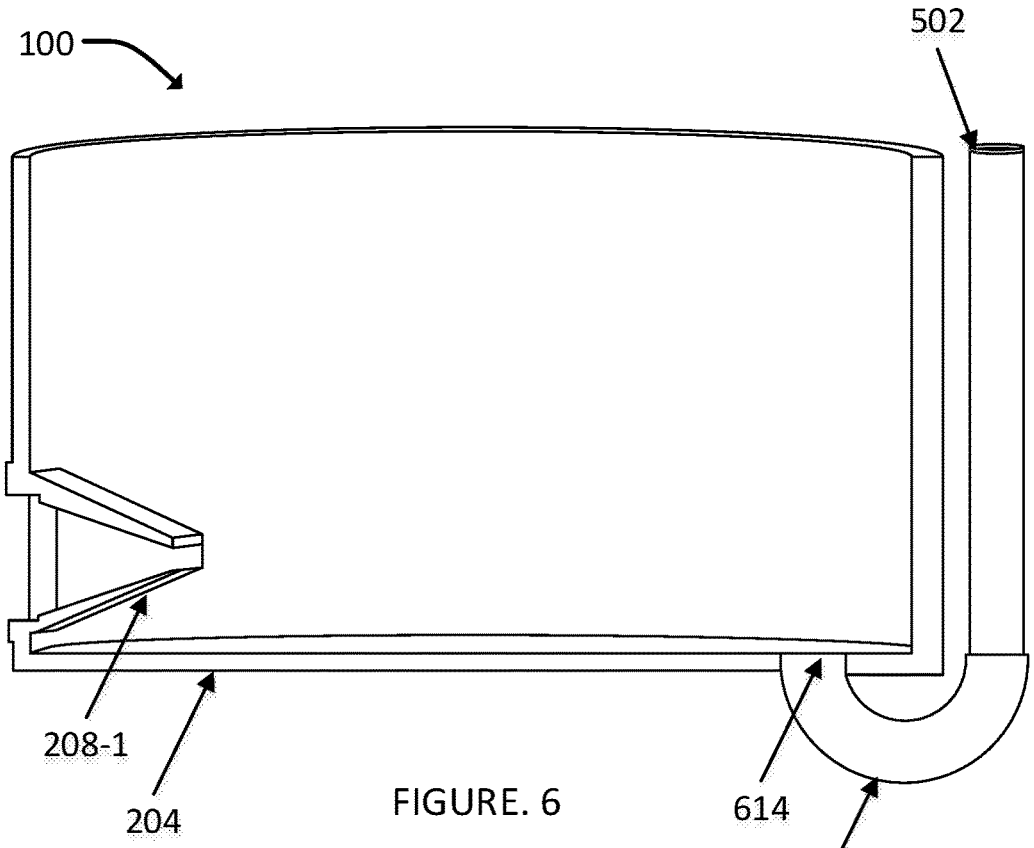

As shown in FIG. 6, the fluid control flow chamber (204) may consist of only a single chamber. The first end (208-1) of the air tunnel (208) disposed in the first sub-chamber (510) is in the form of a nozzle to increase velocity and pressure of the external air directed into the fluid control flow chamber (204). The fluid control flow chamber (204) may include a fluid entrance slot (614) to receive the liquid discharged from the container (102), the fluid entrance slot (614) receiving the liquid from the liquid delivery tube (502) having a curved part (504) adapted to pass the liquid into the fluid control flow chamber (204) when suction pressure is generated in the discharge opening (206) of the fluid control flow chamber (204). According to an embodiment of the present invention, the liquid delivery tube (502) having the curved part (504) may be positioned such that the curved part (504) is vertically aligned with respect to the fluid control flow chamber (204).

Figure 7A:
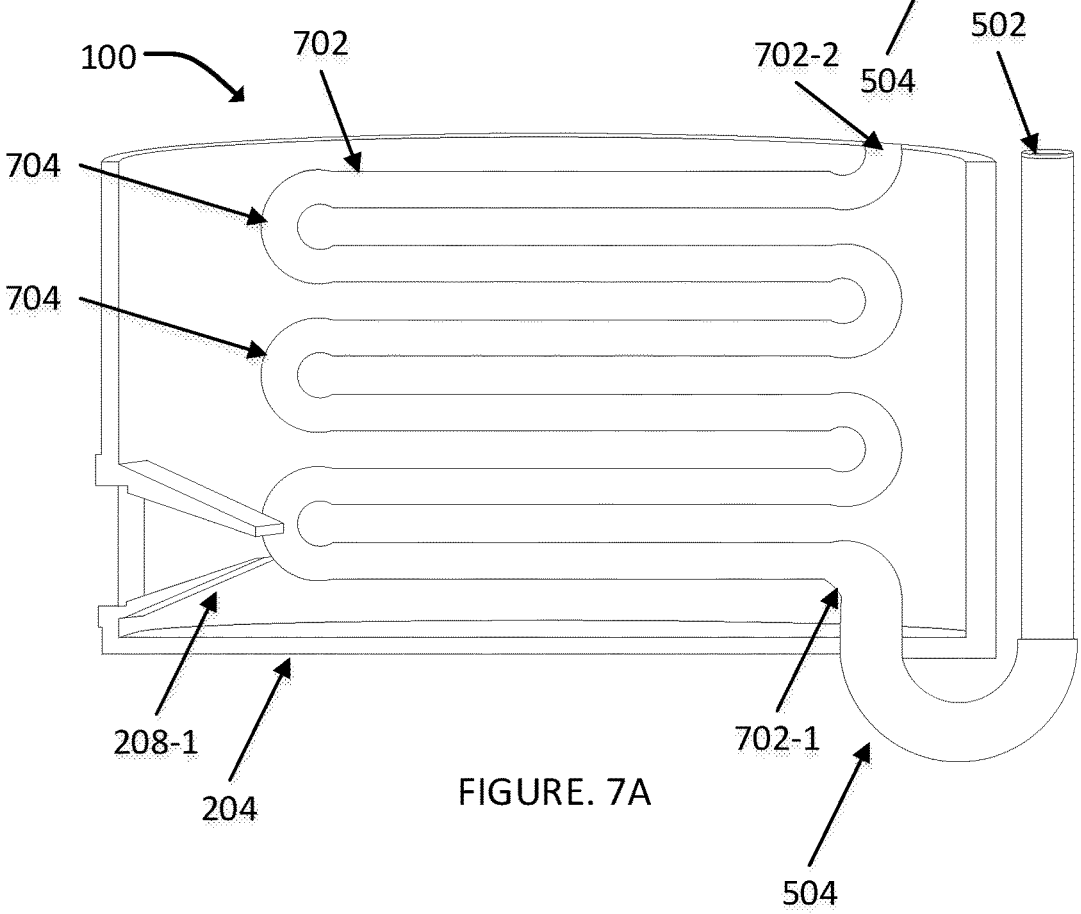
Figure 7B:
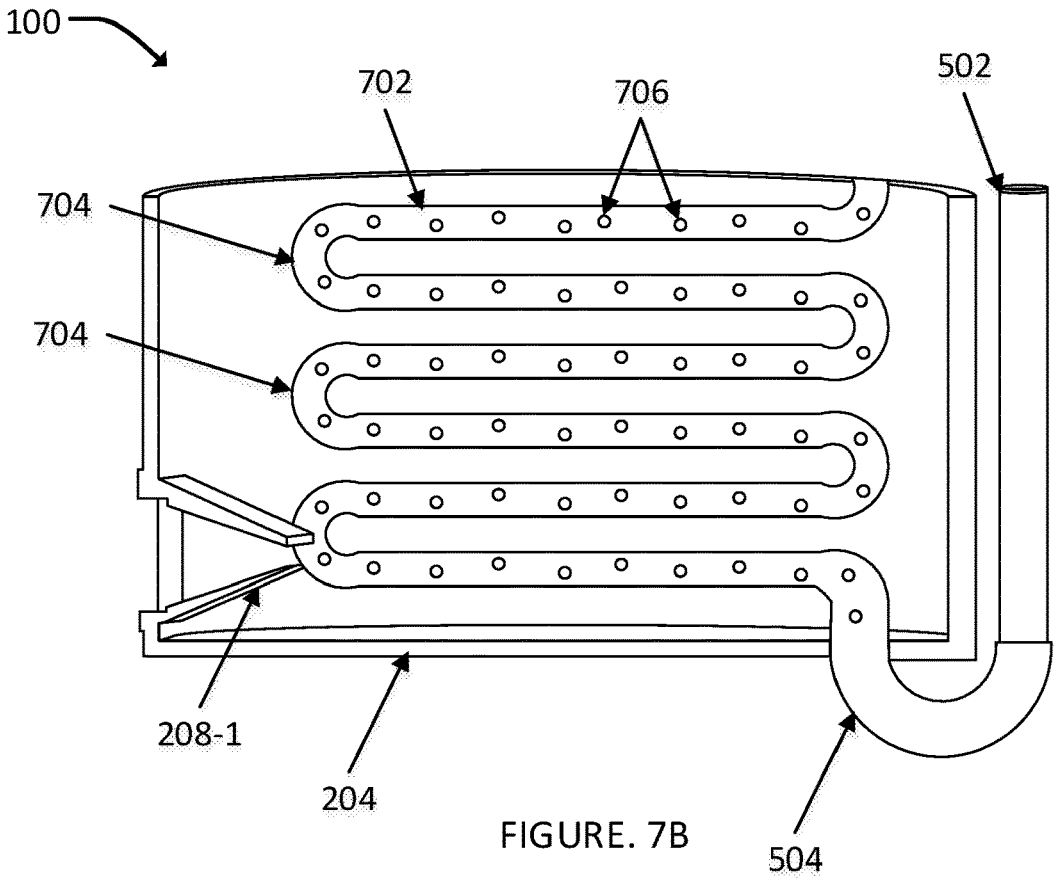

Referring now to FIGS. 7A and 7B, in which embodiments pertaining to the fluid control flow chamber (204) containing a spiral tube (702) are shown. According to an embodiment of the present invention, the spiral tube (702) may include a plurality of curved parts (704) to increase mixing area when the liquid passes through the spiral tube (702) towards the discharge opening (206) of the fluid control flow chamber (204).

According to an embodiment of the present invention, the spiral tube (702) may include a proximal end (702) connected to the fluid entrance slot (614) and a distal end (702-2) connected to the discharge opening (206) of the fluid control flow chamber (204).

As shown in FIG. 7B, the spiral tube (702) has the plurality of curved parts (704). The spiral tube (702) may also include a plurality of spaced bubble-forming apertures in the spiral tube (702). According to another embodiment of the present invention, the spiral tube (702) may include a plurality of stepped portions (706) having reduced diameter to increase pressure when the liquid passes through the spiral tube (702) towards the discharge opening (206) of the fluid control flow chamber (204).

Figure 8:
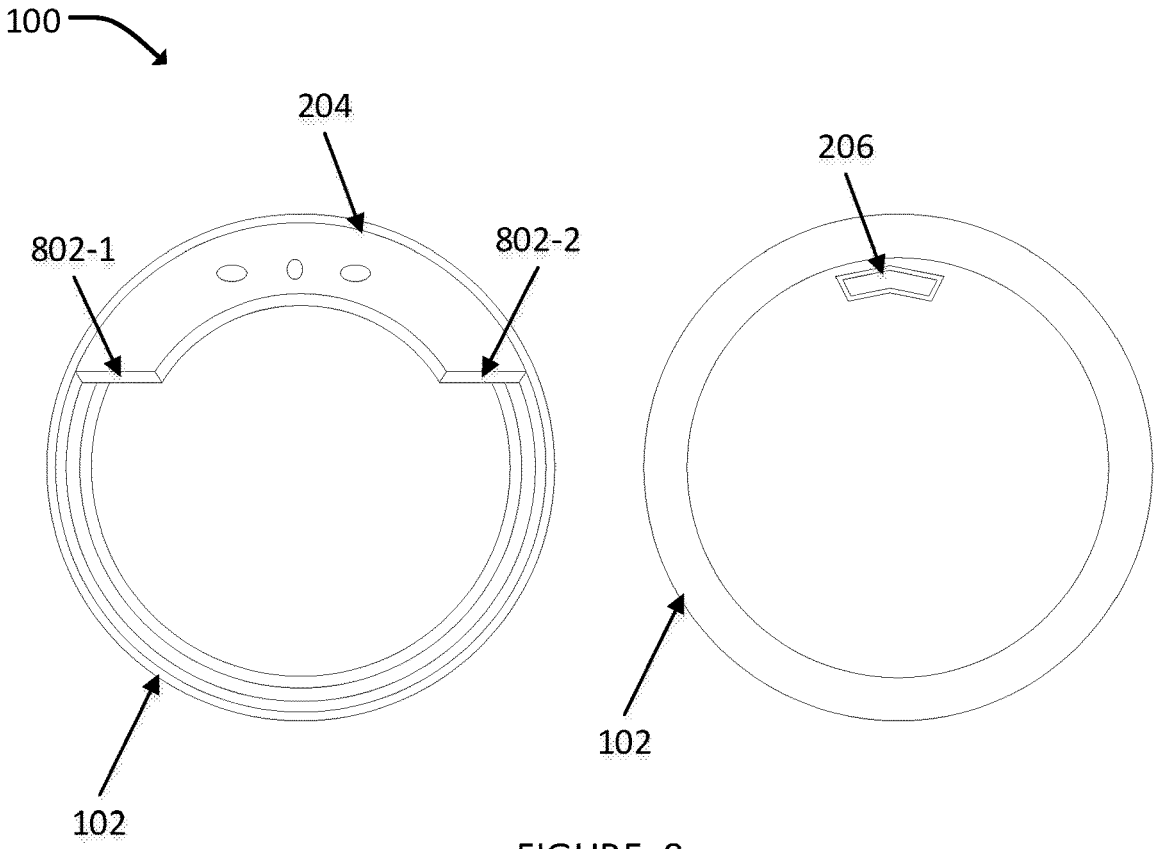

As shown in FIG. 8, the fluid control flow chamber (204) may be in the form of a tube/pipe having a plurality of holes (214). The ends (802-1, 802-2) of the fluid control flow chamber (204) may be connected to the air tunnel (208). According to another embodiment of the present invention, the ends (802-1, 802-2) of the fluid control flow chamber (204) may be adapted to receive the external air.

Figure 9:
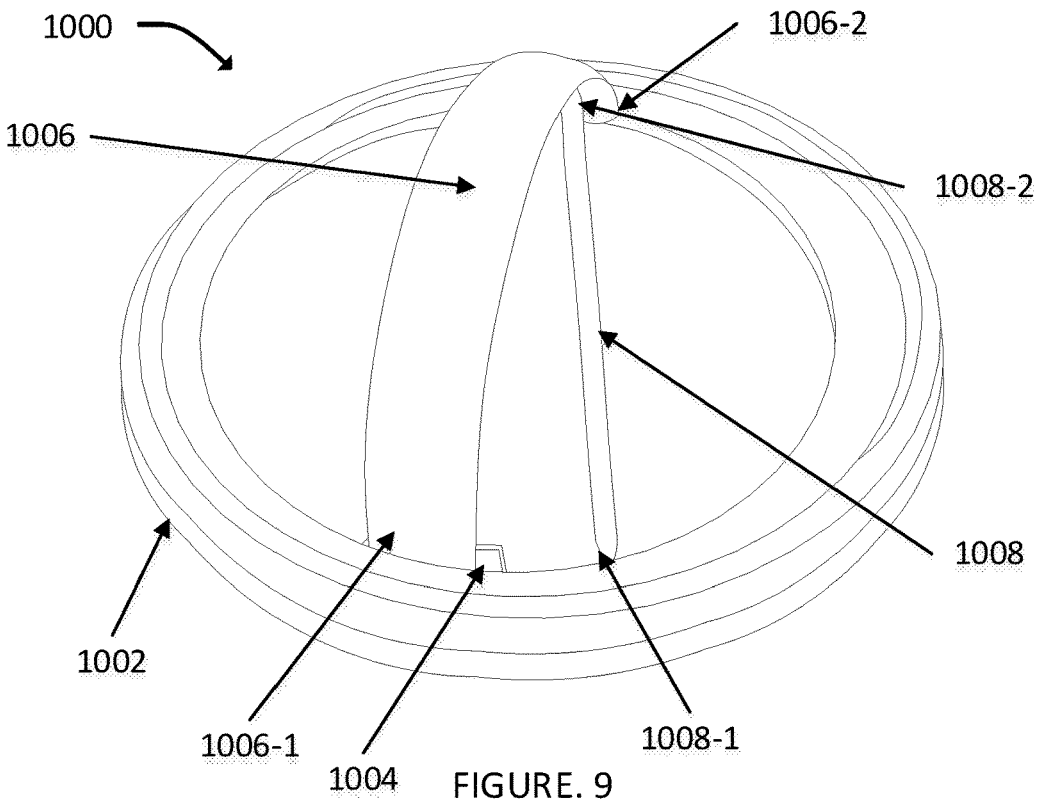
FIG. 9 illustrates another embodiment of the lid assembly.

FIG. 9 illustrates another embodiment of the lid assembly. As shown, the lid assembly (1000) includes a lid (1002) having a discharge opening (1004), at least one air tunnel (1006) having a first end (1006-1) connected to the discharge opening (1004) and a second end (1006-2) passing through the lid (1002) such that the second end (1006-2) is disposed outside the lid (1002), and a liquid delivery tube (1008) having a first end (1008-1) configured to receive a liquid discharged from the container (102) and a second end (1008-2) disposed in proximity of the second end (1006-2) of the at least one air tunnel (1006).

The second end (1006-2) of the air tunnel (1006) directs external air to the first end (1006-1) of the air tunnel (1006). The external air directed to the first end (1006-1) of the air tunnel (1006) is mixed with the liquid passing through the second end (1008-2) of the liquid delivery tube (1008), when suction pressure is generated in the discharge opening (1004) of the lid (1002).

According to an embodiment of the present invention, the air tunnel (1006) may be a tube having a curved profile. According to another embodiment of the present invention, the air tunnel (1006) may be a tube having a flat profile.

Figure 2A:
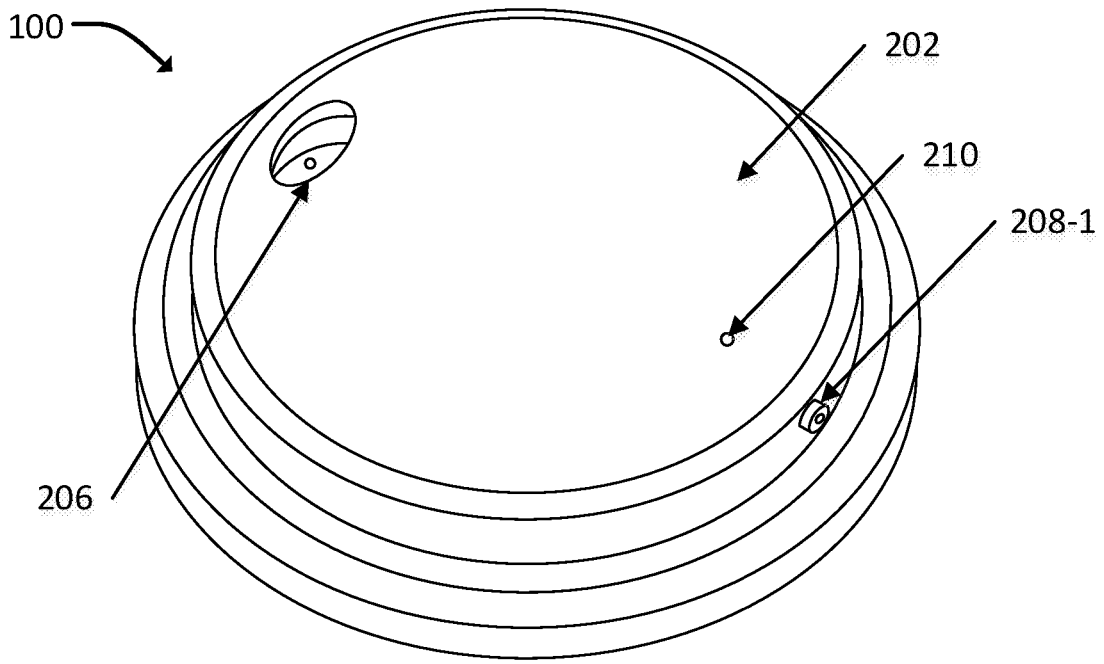
FIGS. 2A through 2D illustrate exemplary perspective view representations of the lid assembly in accordance with embodiments of the present invention.
Figure 2B:
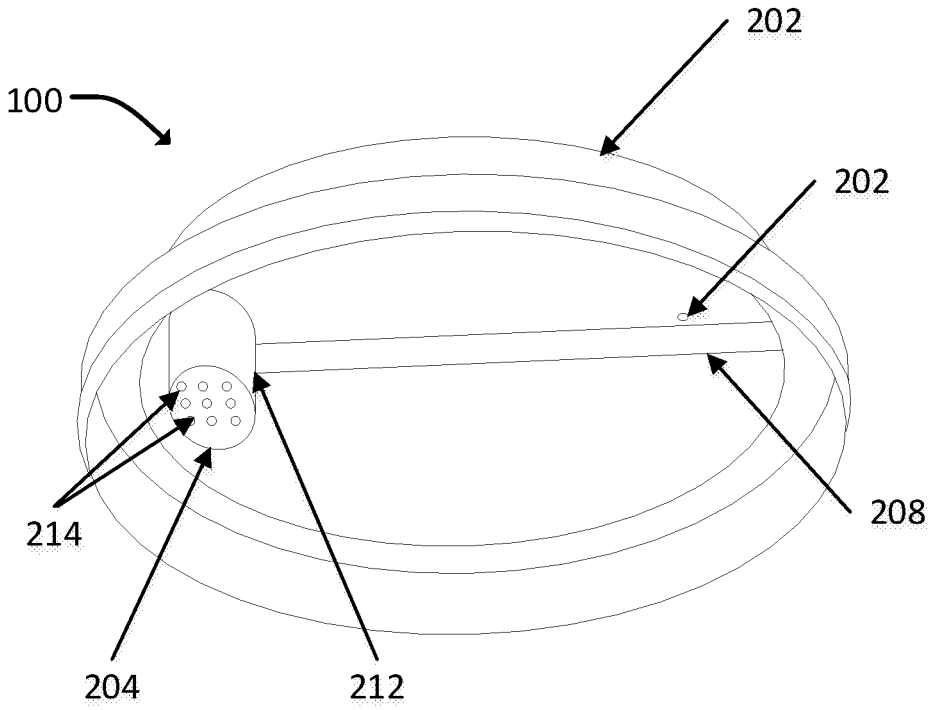
Figure 2C:
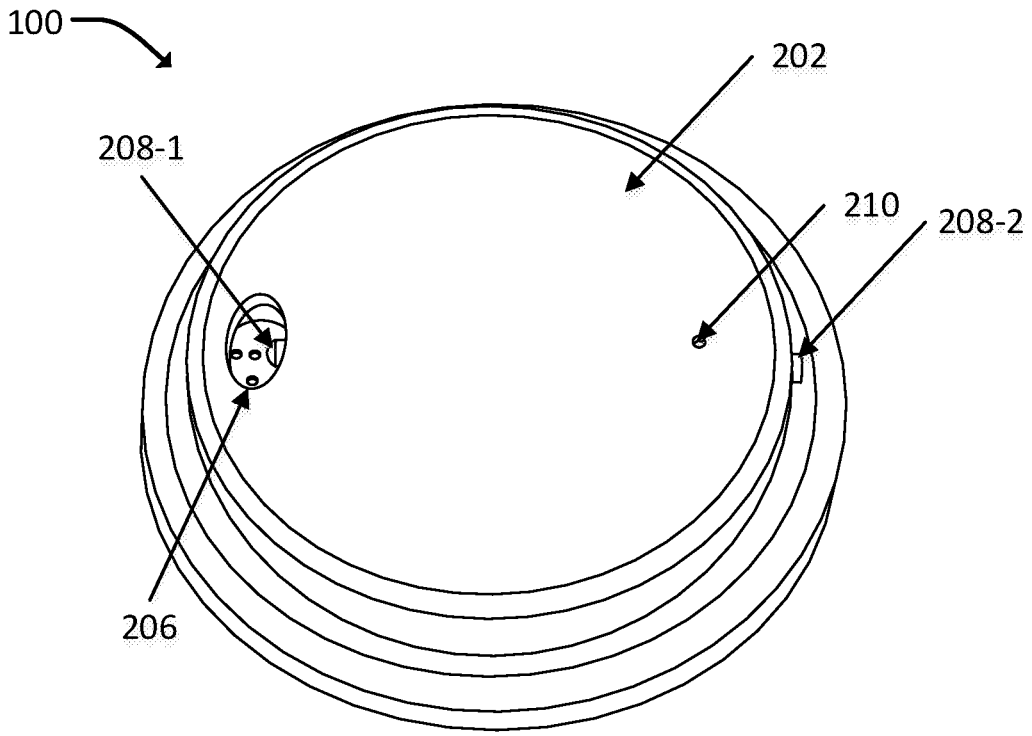
Figure 2D:
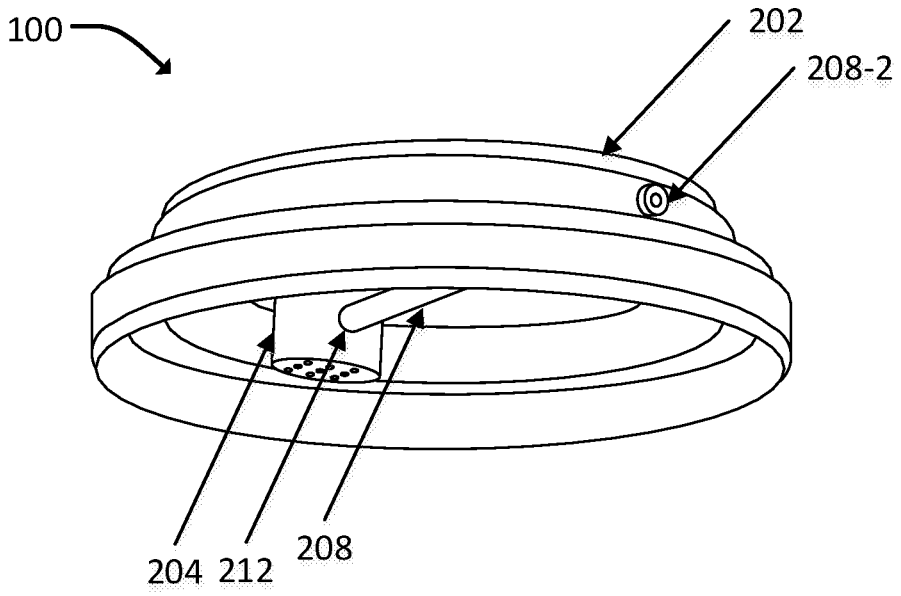
Figure 10:
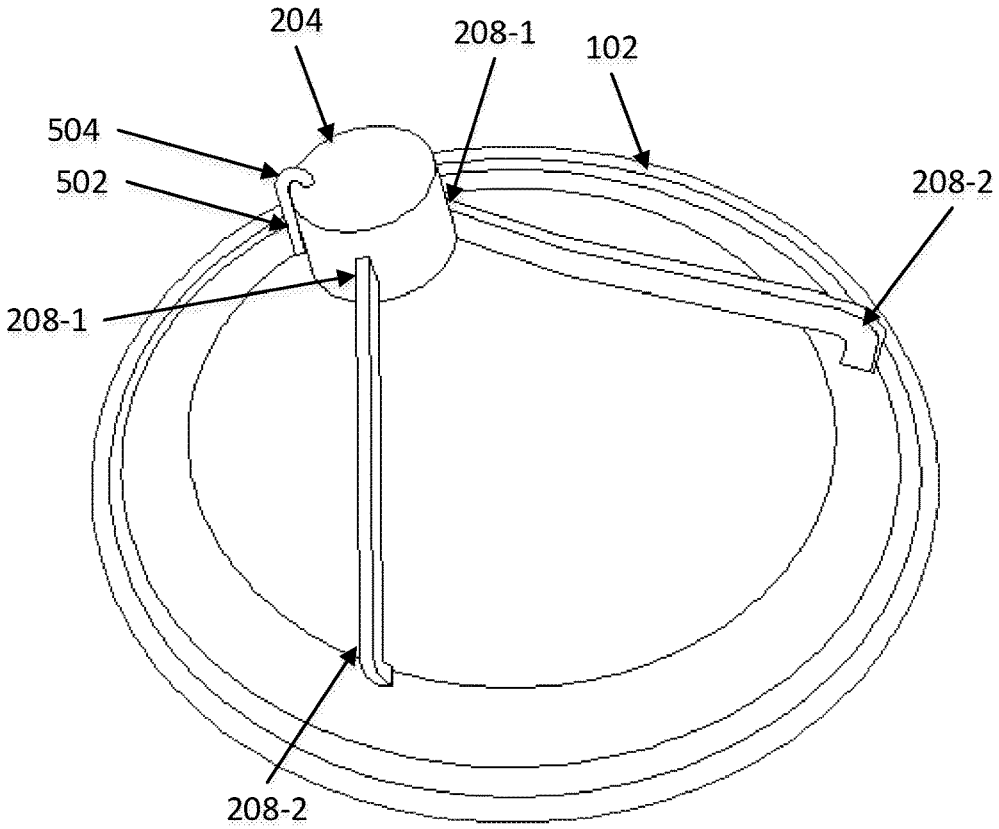
FIG. 10 illustrates an exemplary representation of the fluid control flow chamber configured with two air tunnels, in accordance with embodiments of the present invention.

As shown in FIGS. 4B and 10, the lid assembly (100) may include more than one air tunnel (208) connected to the fluid control flow chamber (204) via connection slots (212). The fluid control flow chamber (204) mixes the external air directed through the air tunnels (208) with the liquid received from the liquid delivery tube (502) having the curved profile (504), which prevents unnecessary spilling or sloshing of the liquid, and allows discharge of the liquid through the discharge opening (206), as shown in FIGS. 2A and 8, only when the suction pressure is generated therefrom.

Figure 11:
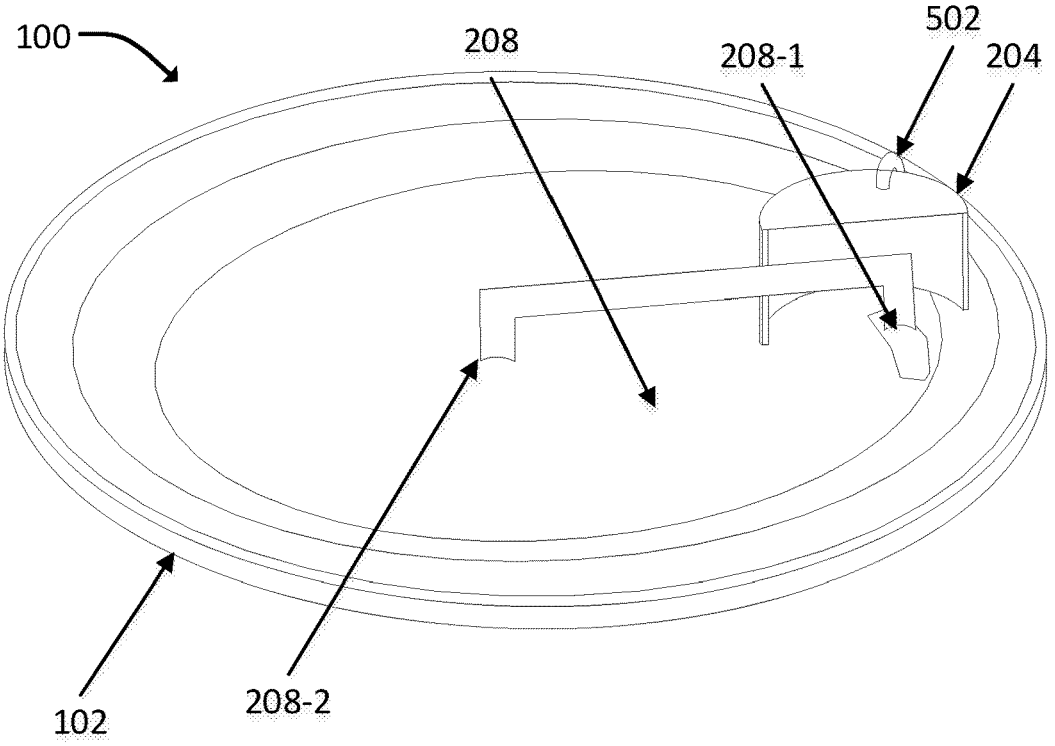
FIG. 11 illustrates an exemplary sectional view representation of a lid assembly, in which the second end of the air tunnel is positioned at the top portion of the lid, in accordance with embodiments of the present invention.

FIG. 11 illustrates a section view of the lid assembly (100), in which the second end (208-2) of the air tunnel (208) is positioned at any area of the upper part of the lid (102) to suck in the external air and direct the same to the fluid control flow chamber (204).

Figure 12:
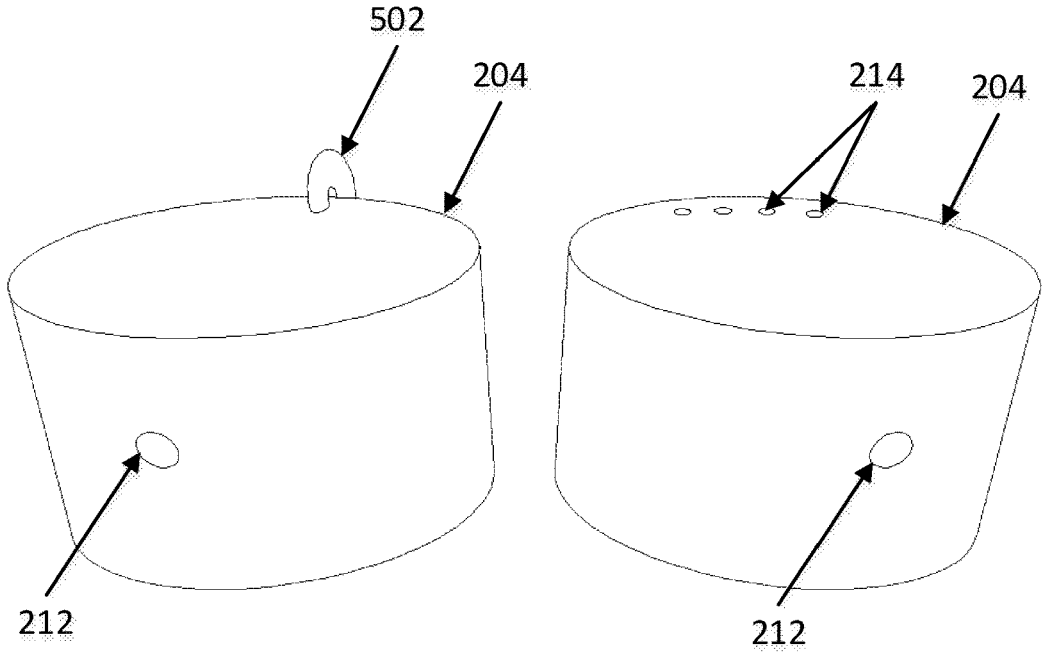
FIG. 12 illustrates an exemplary representation of multiple configurations of the fluid control flow chamber for receiving the liquid discharged from the container, in accordance with embodiments of the present invention.

FIG. 12 illustrates multiple configurations of the fluid control flow chamber (204) for receiving the liquid discharged from the container (102). As shown, the fluid control flow chamber (204) may receive the liquid through a liquid delivery tube (502) having a suitable profile as per design requirements. Additionally, or alternatively, the fluid control flow chamber (204) may receive the liquid through the plurality of holes (214).

Thus, the present invention relates to a lid assembly (100) for outfitting a container (102), while minimizing the spilling, sloshing, or leakage of the beverage from the container (102) through the lid discharge opening (206) and providing means for cooling a beverage discharged from the container (102) immediately before entering the drinker's mouth. The lid assembly (100) also decreases the possibility of scald burn hazards to drinker and is capable of being retrofitted to containers of various shapes and sizes.

While embodiments of the present disclosure have been illustrated and described, it is clear that the disclosure is not limited to these embodiments only. Numerous modifications, changes, variations, substitutions, and equivalents will be apparent to those skilled in the art without departing from the spirit and scope of the disclosure, as described in the claims.

The invention claimed is:

1. A lid assembly (100) for a container (102), comprising a lid (202);

a fluid control flow chamber (204) having a discharge opening (206) on an upper surface of the lid (202); and at least one air tunnel (208) passing through a connection slot (212) to the fluid control flow chamber (204), the at least one air tunnel (208) having a first end (208-1) disposed in the fluid control flow chamber (204), and a second end (208-2) passing through the lid (202) such that the second end (208-2) is disposed outside the lid (202), wherein the second end (208-2) of the at least one air tunnel (208) directs external air to the first end (208-1) of the at least one air tunnel (208), wherein the fluid control flow chamber (204) mixes the external air directed to the first end (208-1) of the at least one air tunnel (208) with a liquid discharged from the container (102), when a suction pressure is generated in the discharge opening (206) of the fluid control flow chamber (204), wherein the fluid control flow chamber (204) comprises therein a spiral tube (702) having a plurality of curved parts (704) to increase mixing area when the liquid passes through the spiral tube (702) towards the discharge opening (206) of the fluid control flow chamber (204), the spiral tube (702) comprising:

a proximal end (702-1) connected to a fluid entrance slot (514) of the fluid control flow chamber (204), and a distal end (702-2) connected to the discharge opening (206) of the fluid control flow chamber (204), and wherein the spiral tube (702) comprises a plurality of stepped portions (706) with reduced diameters to increase fluid pressure and enhance cooling as the liquid flows through the spiral tube (702) towards the discharge opening (206) of the fluid control flow chamber (204).

2. The lid assembly (100) as claimed in claim 1, wherein the fluid control flow chamber (204) comprises a plurality of holes (214) to control flow of the liquid discharged from the container (102) to flow towards the discharge opening (206).

3. The lid assembly (100) as claimed in claim 1, wherein the first end (208-1) of the at least one air tunnel (208) is disposed in the fluid control flow chamber (204) to introduce external air into the fluid control flow chamber (204) along a predefined path designed to enhance cooling efficiency, and wherein the second end (208-2) of the at least one air tunnel (208) is disposed outside the lid (202) and is configured to draw in external air when a suction pressure is applied in at the discharge opening (206) of the fluid control flow chamber (204).

4. The lid assembly (100) as claimed in claim 1, wherein the fluid control flow chamber (204) is integrally formed within the lid (202), such that boundaries of the fluid control flow chamber (204) are molded as part of the lid (202).

5. The lid assembly (100) as claimed in claim 1, wherein the at least one air tunnel (208) is positioned beneath the upper surface of the lid (202).

6. The lid assembly (100) as claimed in claim 1, wherein the fluid entrance slot (514) is configured to receive the liquid discharged from the container (102), the fluid entrance slot (514) receiving the liquid from a liquid delivery tube (502) having a curved part (504) adapted to pass the liquid into the fluid control flow chamber (204) when suction pressure is generated in the discharge opening (206) of the fluid control flow chamber (204).

7. The lid assembly (100) as claimed in claim 1, wherein the spiral tube (702) comprises a plurality of curved parts (704) comprises a series of spaced bubble-forming apertures distributed along the length of the spiral tube (702) to facilitate additional mixing and enhance cooling efficiency when the liquid passes through the spiral tube (702) towards the discharge opening (206) of the fluid control flow chamber (204).

* * * * *